US005201954A

United States Patent [19]

Holt

[11] Patent Number: 5,201,954

[45] Date of Patent: Apr. 13, 1993

[54] MULTILAYER PEELABLE WALL COVERING

[75] Inventor: Earl R. Holt, Rochester Hills, Mich.

[73] Assignee: Hose Specialties Company/Capri, Inc., Highland Park, Mich.

[21] Appl. No.: 778,775

[22] Filed: Oct. 18, 1991

[51] Int. Cl.[5] ..... B05B 15/12; B05C 15/00

[52] U.S. Cl. ..... 118/309; 118/634; 118/326

[58] Field of Search ..... 118/309, 326, 324, DIG. 7, 118/634

[56] References Cited

U.S. PATENT DOCUMENTS

| | | | |
|---|---|---|---|
| 3,788,941 | 1/1974 | Kupits | 428/352 |
| 4,151,319 | 4/1979 | Sackoff et al. | 428/40 |
| 4,162,237 | 7/1979 | Kauderer | 260/42.18 |
| 4,323,030 | 4/1982 | Lehmann, Jr. | 118/309 |
| 4,355,074 | 10/1982 | Stemmler et al. | 428/350 |
| 4,499,130 | 2/1985 | Questel et al. | 428/42 |
| 4,505,964 | 3/1985 | Dierichs et al. | 428/85 |
| 4,555,441 | 11/1985 | Rothenberg | 428/284 |
| 4,650,704 | 3/1987 | Rothenberg | 428/40 |
| 4,751,121 | 6/1988 | Kuhnel et al. | 428/40 |
| 4,900,604 | 2/1990 | Martinez et al. | 428/79 |

*Primary Examiner*—Michael G. Wityshyn
*Assistant Examiner*—Charles K. Friedman
*Attorney, Agent, or Firm*—Harness, Dickey & Pierce

[57] ABSTRACT

A booth for spraying a coating of material on an article. The booth includes a device for spraying material proximate to the article to be coated thereby generating an overspray. The booth also includes a wall for containing the overspray within the booth. Finally, the booth includes a plurality of wall covering units, each of which has a base layer and a plurality of removable sheets.

16 Claims, 2 Drawing Sheets

MULTILAYER PEELABLE WALL COVERING

BACKGROUND OF THE INVENTION

1. Field of the Invention

This invention relates generally to the application of spray coatings to articles, and more particularly to booths which are used for the application of spray coatings to automobile components.

2. Description of Related Art

Spray booths are often used to apply coatings of paint to various articles such as automobile components. Such spray booths often have tracks or similar devices for bringing the component to be painted into the spray booth and then to carry the component through the spray booth. While the automobile component is within the spray booth, paint is either manually or automatically sprayed on the component. Once the component has been coated with paint, the component leaves the spray booth and may typically enter an oven where the paint is dried.

An undesirable characteristic often associated with the use of spray booths is that their walls may become coated with much of the airborne paint particles which do not adhere to the component being painted. Such airborne particles are generally known as "overspray." The presence of overspray is undesirable for several reasons. First, as overspray accumulates on the walls of a spray booth, the overspray tends to flake and peel away from the walls. These dirt balls or residue may then come into contact with an automobile as it is being painted thereby causing the coating of the paint applied to the vehicle to become nonuniform. Such nonuniformity may interfere with the appearance of the automobile to such an extent that at least a portion of the automobile must be repainted.

Secondly, the walls of the spray booths are often cleaned with certain solvents so as to remove the overspray on the walls. In this regard, it is not uncommon to clean the overspray after a period of as little as eight hours of continuous use (i.e., at the end of an eight-hour shift). As will be appreciated by those skilled in the art, the process of cleaning a spray booth is a very time consuming process and may often cause the spray booth to be inoperable for a period of up to approximately 3–4 hours. In addition, there may be as many as 4–6 individuals which may have to be continuously used by one particular automotive manufacturing facility in order to clean the overspray from the spray booths of that facility. The use of solvents in the removal of overspray from the walls of spray booths may also cause a release of solvent vapors into the atmosphere. Such a release of solvent vapors may run afoul of environmental emission guidelines which may be established by the automotive manufacturer or by governmental agencies.

SUMMARY OF THE INVENTION

Accordingly, it is the primary object of the present invention to provide a spray booth having a protective wall covering which can be easily removed so as to avoid substantial accumulation of overspray within the spray booth.

An additional object of the present invention is to minimize the possibility that unwanted paint flakes will come into contact with the surface of an article while the article is being painted.

Another object of the invention is to provide a spray booth having a protective wall covering which is relatively easy and economical to use.

It is yet another object of the present invention to minimize the regular use of solvents in conjunction with the cleaning of spray booths.

A further object of the present invention is to increase manufacturing productivity by eliminating the down time associated with the removal of overspray from spray booths.

BRIEF DESCRIPTION OF THE DRAWINGS

Other objects of the present invention will become apparent to one skilled in the art upon reading the following specification and by reference to the following drawings in which.

DETAILED DESCRIPTION OF THE PREFERRED EMBODIMENT

Figure 1:
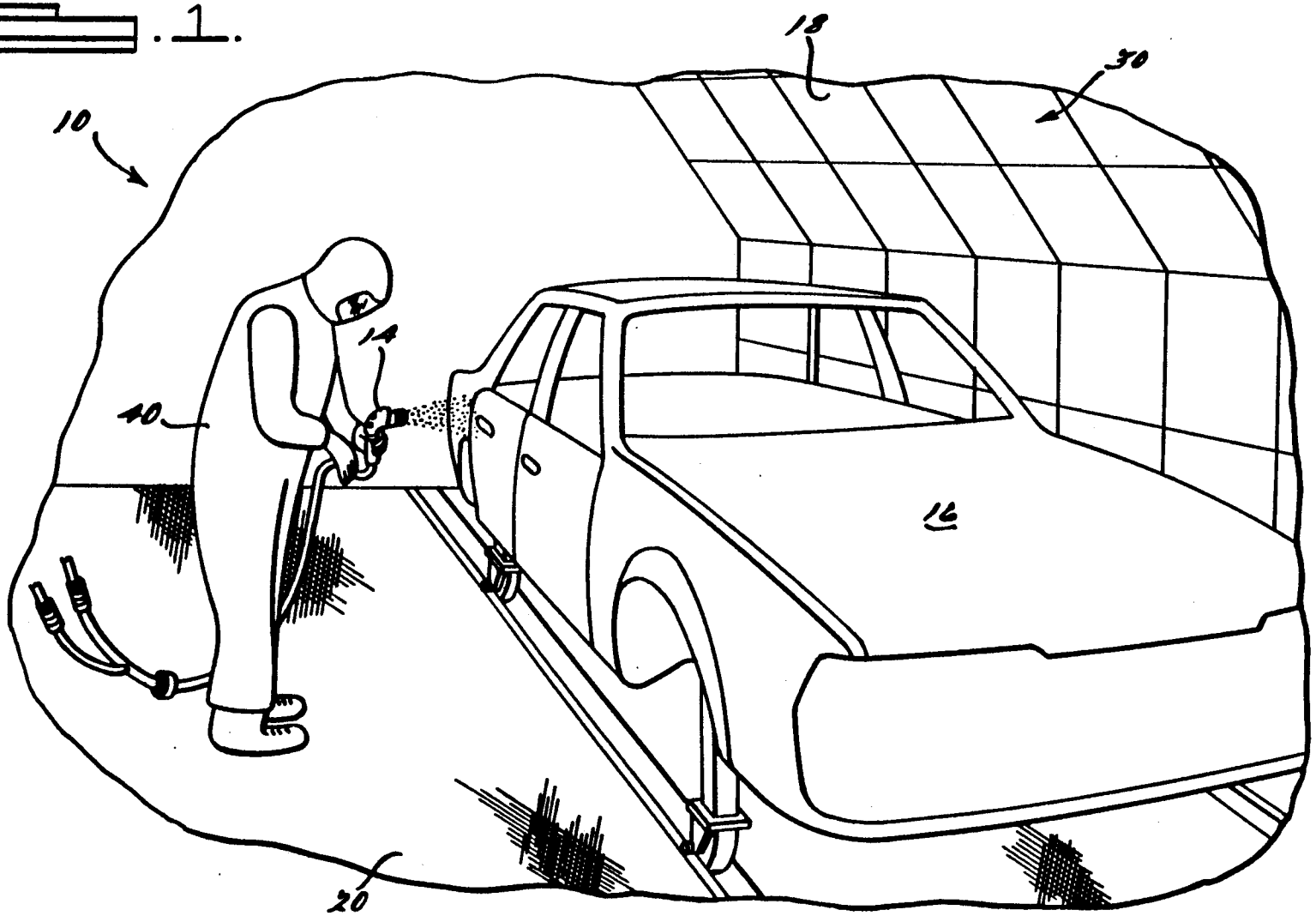
FIG. 1 is a perspective view of an automotive paint spray booth showing a plurality of protective wall covering units according to the teachings of the preferred embodiment of the present invention.

Referring to FIG. 1, there is illustrated an automotive paint spray booth 10 according to the preferred embodiment of the present invention. The paint spray booth 10 is shaped in a manner which resembles an elongated tunnel in which paint is introduced in the form of a spray emitted by one or more handheld spray guns 14. The spray gun 14 and related components may be that which was disclosed in U.S. Ser. No. 07/237,838 which was filed on Aug. 29, 1988, though other suitable components may be used. In addition, the spray gun 14 may be part of a monoline coaxial paint circulating system available from Hose Specialties/Capri, Inc. The spray booth 10 is used to paint automobile components which are generally designated by the numeral 16. The spray booth 10 is defined in part by the walls 18 as well as the floor 20. The walls 18 and the floor 20 are used to confine the overspray (i.e., the paint which does not adhere to the automobile 12) within the booth 10.

It will be understood that the spray booth 10 may be used to paint other types of articles in addition to the automobile components 16. In addition, it will be appreciated that the booth 10 may be used to apply other types of coatings in addition to paint to various articles.

As will be appreciated by those skilled in the art, some of the paint which is emitted by the spray gun 14 adheres to the automobile component 16 while the remainder of the spray (i.e., the overspray) eventually settles either on the walls 18 or the floor 20 of the booth 10. In spray booths of previous designs, the overspray generated during painting often caused two related problems. First, the buildup of overspray on the walls of a spray booth eventually causes paint flakes to fall off the walls of the booth. If these flakes impinge on to the automobile 10 component before the paint has dried, the finish on the component will be somewhat less than desirable and often will result in the need to repaint at least a portion of the component. Second, the removal of overspray from the walls of the spray booth often involves extensive cleaning efforts. Such cleaning efforts are generally time consuming and expensive both in terms of manpower as well as the costs of solvents needed to clean the walls of the spray booth. In addition, the use of solvents may create vapors which exceed guidelines either imposed by governmental agencies or by the manufacturer using the spray booth.

To alleviate this problem, the spray booth 10 comprises a plurality of wall covering units. Each of the wall covering units include a base layer having first and second substantially parallel surfaces. The first surface of the base layer includes means for securing the base layer to the wall of the spray booth 10. In addition, the wall covering unit has a plurality of removable sheets disposed on the second surface of the base layer. At least one of the removable sheets (i.e., the "first removable sheet") has means for securing the first surface of the first removable sheet to a second removable sheet. In addition, the first removable sheet has a second surface which is operable to receive a third removable sheet.

By using a plurality of wall covering units as described above, the overspray generated by the spray gun 14 can be removed by removing the outermost removable sheets associated with the wall covering units. This permits the overspray to be removed from the booth prior to allowing paint flakes generated by the overspray to come into contact with the automobile component 16. In addition, the overspray generated in the spray booth 10 can be removed from the spray booth 10 without extensively cleaning the walls with solvents thereby reducing the costs associated with cleaning the spray booth 10 both in terms of manpower as well as the costs of solvents used to clean the spray booth 10. Finally, because the use of solvents is reduced, there is less of an opportunity for solvent vapors to exceed environmental guidelines either imposed by governmental agencies or by the manufacturer using the spray booth 10.

Figure 2:
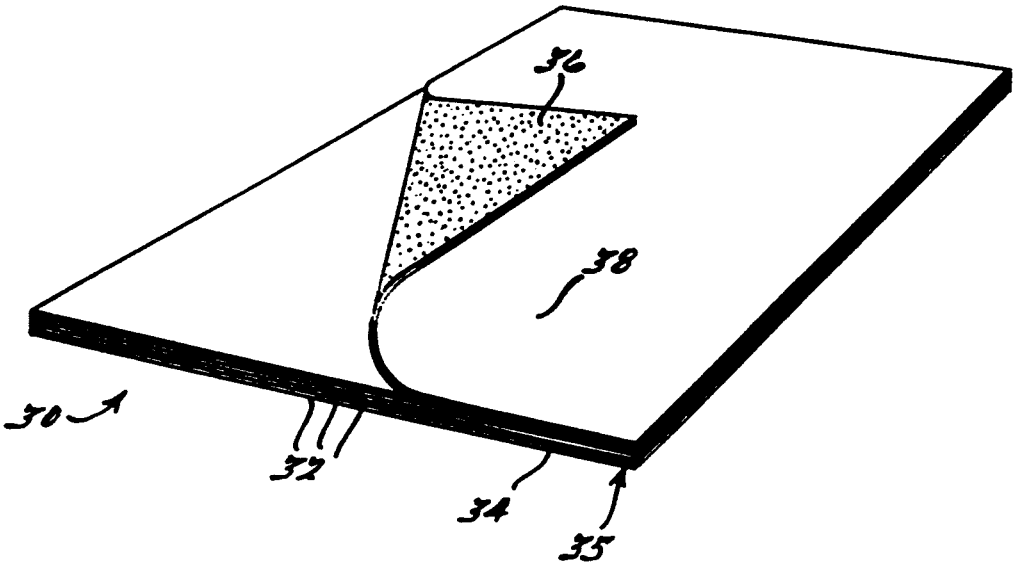
FIG. 2 is an elevational view of a protective wall covering unit shown in FIG. 1 according to the teachings preferred embodiment of the present invention in which the outermost layer is partially removed.
Figure 3:
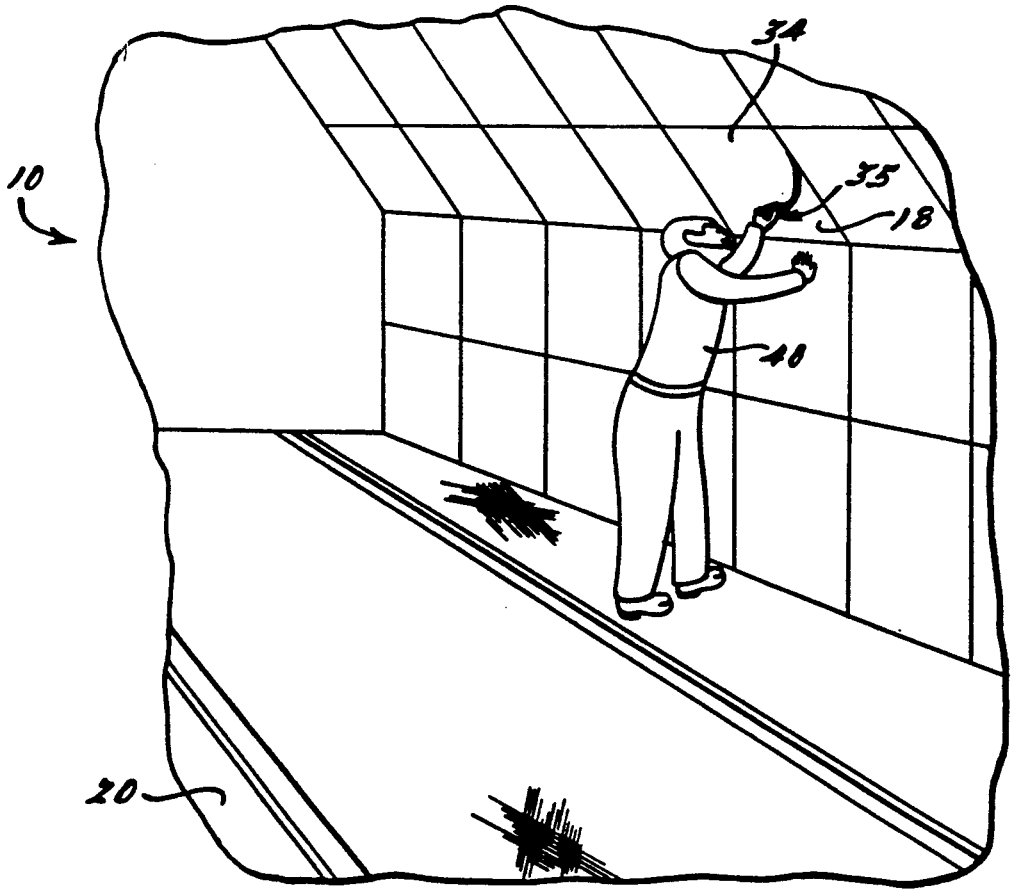
FIG. 3 is a perspective view of the spray booth shown in FIG. 1 in which overspray is being removed from the booth according to the teachings of the preferred embodiment of the present invention.

The structure of the wall covering units, generally designated by the numeral 30, will now be described with reference to FIG. 2. To provide means for removably securing the wall covering unit 30 to the wall 18, the wall covering unit 30 comprises a base layer 34 having first and second substantially parallel surfaces. The base layer 34 is generally rectangular in shape and has a pressure sensitive adhesive disposed on the first or lower surface of the base layer 34. The adhesive disposed on the first surface of the base layer 34 is used for removably securing the wall covering unit 30 to the wall 18. The base layer 34 may therefore be installed on the wall 18 of the spray booth 10 by positioning the wall covering unit 30 proximate to the desired position on the wall 18 and then applying a force against the wall covering unit 30 so as to cause the adhesive to secure the base layer 34 against the wall 18.

To allow overspray which has accumulated on the wall covering unit 30 during painting to be removed from the spray booth 10, the wall covering unit 30 further has a plurality of removable sheets 32. Each of the removable sheets 32 are generally rectangular in shape and are substantially the same size as the wall covering unit 30. In addition, each of the removable sheets 32 has a first or bottom surface which contains an adhesive material 36. The adhesive material 36 allows each of the removable sheets to be removably secured to the removable sheet 32 immediately below it. That is, a first removable sheet 32 within the wall covering unit 30 contains an adhesive on its lower surface which allows it to adhere to a second removable sheet 32 immediately below it within the same wall covering unit 30. In addition, a third removable sheet 32 may be disposed directly on top (i.e., on the second surface) of the first removable sheet 32 also by means of the adhesive 36 located on the lower surface of the third removable sheet. While each of the removable sheets 32 may be made from polyethylene and the adhesive material 36 may be microbial biocide adhesive, other suitable materials may be used. In addition, second surfaces of the removable sheets 32 may be lightly coated with an adhesive material to facilitate adhesion of dirt balls and residue.

When there is substantial accumulation of overspray generated by the spray gun 14, the overspray can be removed from the spray booth 10 by simply removing the outermost (i.e., the removable sheet 32 which is furthest from the base layer 34) removable sheets 38 on each of the wall covering units 30. This permits the overspray to be removed from the spray booth 10 without using excessive labor to clean the spray booth 10 and without extensive use of solvents. If only one or two of the wall covering units 30 have substantial accumulation of overspray, the outermost removable sheets 38 on each of these wall covering units 30 may be removed while leaving intact the outermost removable sheets 38 of the other wall covering units 30. That is, not all the outermost removable sheets 38 on each of the wall covering units 30 are necessarily removed during cleaning of the spray booth 10. The painting operation can then continue until there is again a substantial accumulation of overspray on some or all of the wall covering units 30 whereupon the outermost removable sheets 38 are again removed in the manner described above. Once all the removable sheets 32 have been removed from one wall covering unit 30, the remaining base layer 34 of the wall covering unit 30 can be removed from the wall 18 and be replaced by a new wall covering unit 30.

The method for applying coating material to the automobile component 16 will now be described according to the preferred embodiment of the present invention. First, a plurality of wall covering units 30 are attached to the wall 18 of the spray booth 10 so as to cover substantially all of the wall 18. This is accomplished by removably securing the wall covering units 30 to the wall 18 by means of the adhesive which is deposited on the lower surface of each of the base layers 34 of the wall covering units 30. The automobile component 16 is then placed in the spray booth 10 and paint is applied to the automobile component 16 by means of the spray gun 14. As the automobile component 16 is sprayed with paint, overspray is accumulated on the outermost removable sheets 38 of some of the wall covering units 30. After a number of automobile components 16 have been painted, the operator 40 of the spray booth 10 inspects each of the wall covering units 30 to determine which of the wall covering units 30 have a substantial accumulation of overspray (i.e., which of the outermost sheets 38 should be removed to prevent the generation of dirt balls or residue in the spray booth 10). The overspray which is accumulated on the outermost sheet 3 of the wall covering units 30 is then removed from the spray booth 10 by removing the outermost sheets 38 upon which overspray has accumulated. After the removal of the outermost sheets 38 which have accumulation of overspray, additional automobile components 16 may be brought into the spray booth 10 and painted in the manner described above.

While the particular invention has been particularly shown and described with reference to a preferred embodiment, it will be readily appreciated by those of ordinary skill in the art that various changes and modifications in form and details may be made without departing from the spirit and scope of the invention. For example, the wall covering units may be of different shapes and sizes to accommodate the geometry of the spray booth. In addition, the spray booth may also be used to paint other articles in addition to automotive components. Further, the wall covering units may also be used to protect the walls of other types of facilities such as operating rooms from other materials such as biological contaminates. It is, therefore, intended that the appended claims be interpreted as including such changes and modification.

What is claimed is:

1. A booth for spraying a coating of material on an article comprising:

means for spraying said material proximate to said article so as to apply said coating of material to said article, said means for spraying generating overspray;

means for containing said overspray within said booth, said means for containing said overspray including a wall; and a plurality of wall covering units disposed on said wall, each of said wall covering units including:

(a) a base layer having first and second substantially parallel surfaces, said first surface of said base layer having means for securing said base layer to said wall, (b) first and second removable sheets having first and second surfaces, (c) means for securing said first removable sheet to said base layer, and (d) means for securing said second removable sheet to said first removable sheet, whereby said overspray generated by said means for spraying may be removed from said booth by removal of at least one of said removable sheets from said booth.

2. The booth for spraying a coating of material as set forth in claim 1, wherein said means for securing said base layer to said wall comprises an adhesive.

3. The booth for spraying a coating of material as set forth in claim 2, wherein said means for securing said second removable sheet to said first removable sheet comprises an adhesive.

4. The booth for spraying a coating of material as set forth in claim 1, wherein each of said removable sheets has adhesive disposed on one surface, said adhesive disposed on said removable sheets being operable to removably secure each of said removable sheets to an adjacent removable sheet.

5. The booth for spraying a coating of material as set forth in claim 1, wherein said plurality of wall covering units cover substantially all of said wall of said booth.

6. The booth for spraying a coating of material as set forth in claim 1, wherein each of said removable sheets are substantially the same size as said base layer of the wall covering unit upon which they are disposed.

7. The booth as set forth in claim 1, wherein said wall covering units may be removably attached to said wall.

8. The booth as set forth in claim 1, wherein said wall covering units are substantially rectangular in shape.

9. A spray booth having a wall for use in applying a coating of paint to a plurality of automobile components comprising:

means for moving said plurality of automotive components sequentially through said booth;

means for spraying said paint proximate to said automobile components, said means for spraying being operable to generate overspray when applying a coating of paint to said automotive components;

means for protecting said wall from said overspray, said means for protecting being removably secured to said wall and comprising a plurality of wall covering units, each of said wall covering units including:

(a) a base layer having first and second substantially parallel surfaces, said first surface of said base layer having means for securing said base layer to said wall; and (b) a first and second removable sheet having first and second surfaces, (c) means for securing said first removable sheet to said base layer, and (d) means for securing said second removable sheet to said first removable sheet, whereby said overspray generated by said means for spraying may be removed from said booth by removal of at least a portion of said means for protecting.

10. The spray booth as set forth in claim 9, wherein said base layer of each of said wall covering units is attached to said wall by means of an adhesive.

11. The spray booth as set forth in claim 10, wherein the first surface of said first removable sheet is coated with an adhesive.

12. The spray booth as set forth in claim 11, wherein said adhesive disposed on said removable sheets being operable to removably secure each of said removable sheets to an adjacent removable sheet.

13. The spray booth as set forth in claim 12, wherein said plurality of wall covering units cover substantially all of said wall of said booth.

14. The spray booth as set forth in claim 13, wherein each of said removable sheets of said wall covering units are substantially the same size as said base layer of the wall covering unit to which it is associated.

15. The spray booth as set forth in claim 9, wherein said wall covering units may be removably attached to said wall.

16. The spray booth as set forth in claim 9, wherein said wall covering units are substantially rectangular in shape.

* * * * *

UNITED STATES PATENT AND TRADEMARK OFFICE

CERTIFICATE OF CORRECTION

PATENT NO. : 5,201,954

DATED : April 13, 1993

INVENTOR(S) : Earl R. Holt

It is certified that error appears in the above-indentified patent and that said Letters Patent is hereby corrected as shown below:

Column 2, lines 22-23, after "teachings" insert --of the--.

Column 2, line 65, delete "10".

Column 4, line 65, "3" should be --38--.

Column 6, line 37, Claim 9, after "said" insert --spray--.

Signed and Sealed this

Thirtieth Day of August, 1994

*Attest:*

*Attesting Officer*

Bruce Lehman

BRUCE LEHMAN

*Commissioner of Patents and Trademarks*